US008215136B2

(12) United States Patent
Kim et al.

(10) Patent No.: US 8,215,136 B2
(45) Date of Patent: Jul. 10, 2012

(54) LAUNDRY MACHINE HAVING MULTIPLE LAUNDRY TREATMENT DEVICES

(75) Inventors: Joo Yeon Kim, Changwon-Si (KR); Kyung Ah Choi, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 456 days.

(21) Appl. No.: 12/137,245

(22) Filed: Jun. 11, 2008

(65) Prior Publication Data

US 2009/0113945 A1 May 7, 2009

(30) Foreign Application Priority Data

Jun. 13, 2007 (KR) ..... 10-2007-0057876

(51) Int. Cl.
*D06F 31/00* (2006.01)
*B08B 3/12* (2006.01)

(52) U.S. Cl. ..... 68/27; 68/5 C; 68/9; 68/11

(58) Field of Classification Search ..... 68/9, 11, 68/5 C, 27

See application file for complete search history.

(56) References Cited

U.S. PATENT DOCUMENTS

| | | | | |
|---|---|---|---|---|
| 2,570,529 | A * | 10/1951 | Dolan | 68/20 |
| 3,555,701 | A * | 1/1971 | Hubbard | 34/602 |
| 3,672,188 | A * | 6/1972 | Geschka et al. | 68/12.15 |
| 4,400,699 | A * | 8/1983 | Glasmacher | 340/825.22 |
| 5,293,761 | A * | 3/1994 | Jang | 68/15 |
| 5,309,739 | A * | 5/1994 | Lee | 68/3 SS |
| 5,470,142 | A * | 11/1995 | Sargeant et al. | 312/258 |
| 5,784,901 | A * | 7/1998 | Yanase et al. | 68/27 |
| 6,618,887 | B2 * | 9/2003 | Kim et al. | 8/158 |
| 7,060,106 | B2 * | 6/2006 | Kleker | 8/149.1 |
| 2004/0187529 | A1 * | 9/2004 | Kim et al. | 68/207 |
| 2006/0156765 | A1 * | 7/2006 | Sunshine et al. | 68/13 R |

FOREIGN PATENT DOCUMENTS

| | | |
|---|---|---|
| DE | 2 100 373 | 7/1971 |
| DE | 44 04 759 A1 | 8/1995 |
| DE | 20 2004 010 585 U1 | 9/2004 |
| WO | WO 02/12609 A1 | 2/2002 |

OTHER PUBLICATIONS

German Office Action dated Jun. 16, 2009.

* cited by examiner

*Primary Examiner* — Michael Barr
*Assistant Examiner* — Charles W Kling
(74) *Attorney, Agent, or Firm* — KED & Associates, LLP

(57) ABSTRACT

A multiple laundry machine is provided. The multiple laundry machine may include multiple washing spaces capable of separately washing relatively small amounts of laundry in each. The multiple laundry machine may include a casing, and a plurality of individual laundry machines arranged in the casing. Each of the individual laundry machines provided in the casing may conduct washing operations in a different manner so as to provide washing capability of different sizes and types of loads.

7 Claims, 6 Drawing Sheets

LAUNDRY MACHINE HAVING MULTIPLE LAUNDRY TREATMENT DEVICES

This application claims the benefit of Korean Patent Application No. 10-2007-57876, filed on Jun. 13, 2007, which is hereby incorporated by reference as if fully set forth herein.

BACKGROUND OF THE INVENTION

1. Field of the Invention

The present invention relates to a multiple laundry machine, and more particularly to a multiple laundry machine capable of separately washing a small amount of laundry.

2. Discussion of the Related Art

Generally, a laundry machine means an apparatus for washing, drying, or washing and drying laundry. One laundry machine can perform only a washing function or a drying function or can perform both the washing and drying functions. Recently, a laundry machine, which includes a steam supplier, to have a refresh function for, for example, removal of wrinkles, odor, static electricity, etc. from laundry, has been available.

Meanwhile, conventional laundry machines are classified into a front loading type and a top loading type in accordance with the direction that laundry is taken out. Also, conventional laundry machines are classified into a vertical-axis type, in which a pulsator or an inner tub rotates, and a horizontal-axis type, in which a horizontally-extending drum rotates. The representative example of such a horizontal-axis type laundry machine is a drum washing machine or a drum drying machine.

Such laundry machines have a tendency to have a large size, in order to meet the recent demand of users. That is, laundry machines used for domestic purposes have a tendency to have a large outer size.

Generally, only one large-capacity washing machine is equipped in a home. When it is desired to wash different kinds of laundry in an independent manner, using the washing machine, it is necessary to operate the washing machine several times. For example, when it is desired to wash laundry such as adult clothes and laundry such as underclothes or baby clothes in an independent manner, the washing machine operates two times to individually wash the two different kinds of laundry. For this reason, the washing time increases.

Furthermore, it is undesirable to use the large-capacity washing machine in washing a small amount of laundry, in terms of saving of energy, as in conventional cases. This is because the washing course set in the large-capacity washing machine is typical for the case, in which the amount of laundry to be washed is large, so that the amount of water to be consumed in the washing course is large. Also, a large amount of electricity is consumed because it is necessary to rotate a large-size drum or pulsator. In additional, since the washing course set in the large-capacity washing machine is typical for the case, in which the amount of laundry to be washed is large, the washing time is relatively long.

Also, the washing course set in the large-capacity washing machine is typical for general clothes. For this reason, the large-capacity washing machine may be unsuitable for the washing of delicate clothes such as underclothes or baby clothes.

In addition, the large-capacity washing machine is unsuitable in the case in which washing of a small amount of laundry should be frequently performed. Generally, users collect laundry for several days, in order to wash the collected laundry at one time.

However, leaving laundry, in particular, underclothes or baby clothes, without immediately washing them, is undesirable in terms of cleanliness. Furthermore, when such clothes are left for a long period of time, there is a problem in that they cannot be cleanly washed because dirt may be fixed to the clothes.

In this regard, it is necessary to use a small-size washing machine having a capacity much smaller than the conventional large-capacity washing machine. However, where two small-size washing machines are equipped in a home, and they are laterally arranged in parallel, there are problems associated with space utility and beauty, even though the size of the washing machines is small.

SUMMARY OF THE INVENTION

Accordingly, the present invention is directed to a multiple laundry machine that substantially obviates one or more problems due to limitations and disadvantages of the related art.

An object of the present invention is to provide a multiple laundry machine capable of achieving a washing operation for a small amount of laundry, and separately washing laundry in accordance with the kind of the laundry.

In accordance with one aspect of the present invention, a multiple laundry machine comprises: a casing; and a plurality of laundry machines arranged in the casing, to conduct washing operations in different manners, respectively.

The casing may comprise an accommodating space defined in the casing, to accommodate the plurality of laundry machines.

The accommodating space may be vertically partitioned into sub-spaces to receive the laundry machines, respectively.

The plurality of laundry machines may comprise a first laundry machine to conduct a washing operation for laundry while maintaining the laundry in a fixed state, and a second laundry machine to conduct a washing operation for laundry while applying a rotating force to the laundry.

The first laundry machine may comprise a drainage pipe, and the second laundry machine may comprise a water supply pipe connected to the drainage pipe of the first laundry machine.

The first and second laundry machines may be forwardly slidable from the casing. Alternatively, the first laundry machine may be of a top loading type, and the second laundry machine may be slidably installed.

The first laundry machine may comprise: a tub for providing a washing space; a rack for holding laundry in a fixed state; and a sprayer rotatably installed to spray wash water to the rack.

The tub may be formed to be partially opened at a front side of the tub.

The first laundry machine may further comprise a door for opening/closing the opened portion of the tub.

The rack may be provided with guide protrusions, and the tub may be provided with guide grooves engaged with the guide protrusions, to allow the rack to be outwardly ejectable through the opened portion of the tub, and to allow the rack to be adjusted in level.

The first laundry machine may comprise: a tub for providing a washing space; a rack for holding laundry in a fixed state in the tub; and a plurality of spray ports formed through a wall of the tub, to spray wash water to the rack.

The first laundry machine may comprise: a tub for receiving wash water; and an ultrasonic washer for vibrating the wash water received in the tub, to wash laundry.

The second laundry machine may comprise: a tub for receiving wash water; a pulsator rotatably mounted in the tub, to pulsate the wash water; and a motor for applying a rotating force to the pulsator.

The second laundry machine may comprise: an outer tub for receiving wash water; an inner tub rotatably installed in the outer tub, to pulsate laundry contained in the inner tub; and a motor for providing a rotating force to the inner tub.

The second laundry machine may comprise a steam generator for supplying steam to the tub.

Each of the laundry machines may comprise a heater for heating wash water, to achieve a laundry boiling function.

The multiple laundry machine may further comprise: a controller for controlling overall operation of each of the laundry machines such that the laundry machines are simultaneously controlled; a key input unit for inputting a user command associated with each of the laundry machines; and a display for displaying the user command input through the key input unit or an operation state.

The multiple laundry machine may further comprise: a controller for controlling operations of each of the laundry machines such that the laundry machines are independently controlled; a key input unit for inputting a user command associated with each of the laundry machines; and a display for displaying the user command input through the key input unit or an operation state.

At least one of the laundry machines may be forwardly slidable from the casing.

At least one of the laundry machines may comprise a door mounted to a portion of the casing corresponding to an upper portion of the laundry machine.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention associated with a multiple laundry machine, examples of which are illustrated in the accompanying drawings.

Figure 1:
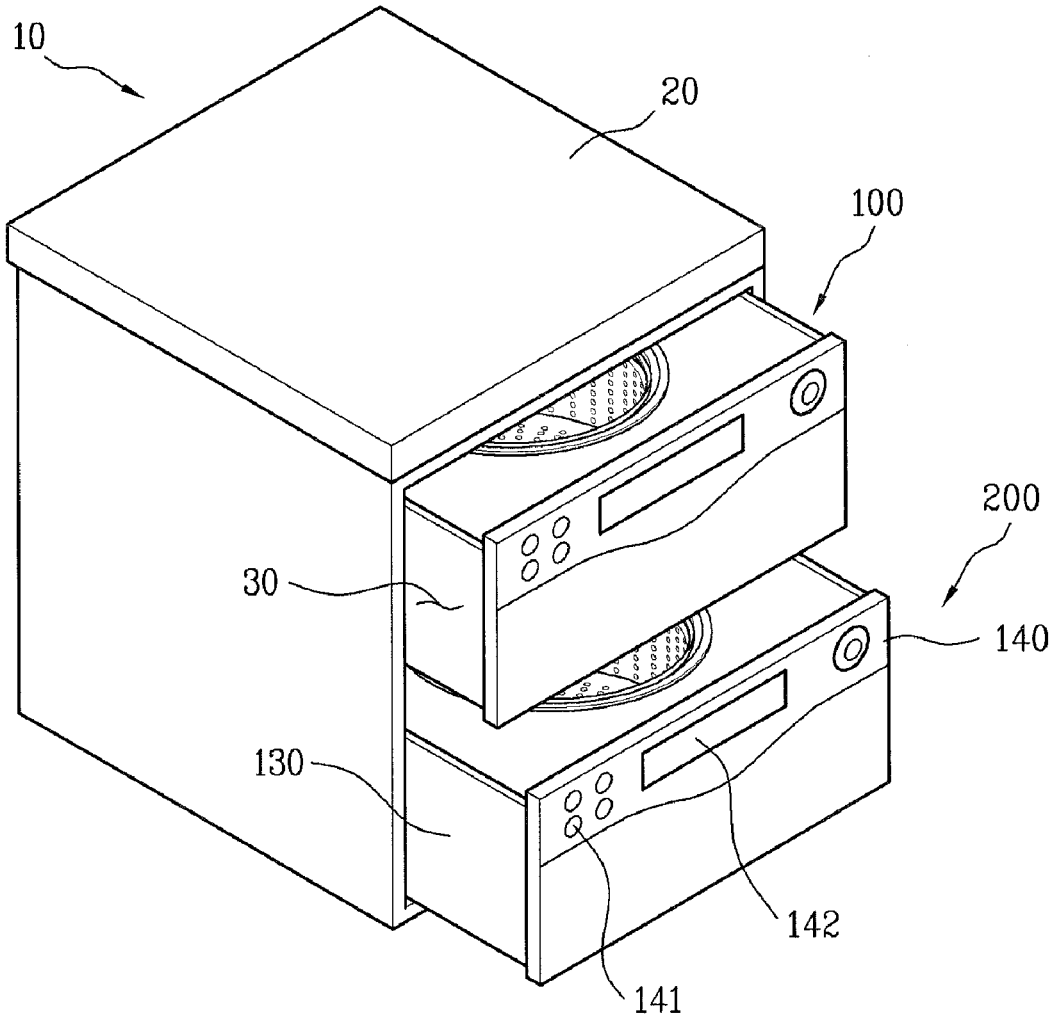
FIG. 1 is a perspective view illustrating a multiple laundry machine according to an exemplary embodiment of the present invention.

FIG. 1 is a perspective view illustrating a multiple laundry machine according to an exemplary embodiment of the present invention.

As shown in FIG. 1, the multiple laundry machine 10 according to the present invention includes a casing 20, and a plurality of laundry machines arranged in the casing 20, to conduct washing operations in different manners, respectively.

An accommodating space 30 is defined in the casing 20, to accommodate the plural laundry machines therein.

The multiple laundry machine 10 according to the present invention includes a plurality of laundry machines to separately wash a small amount of laundry, different from conventional laundry machines. In detail, the plural laundry machines comprise a first laundry machine 100 capable of washing easily-deformable delicate clothes such as underclothes or baby clothes, and a second laundry machine 200 capable of washing laundry requiring a strong washing operation, for example, shoes, etc.

The first laundry machine 100 conducts a washing operation under the condition in which laundry is in a fixed state. On the other hand, the second laundry machine 200 conducts a washing operation under the condition in which a rotating force is applied to laundry.

Preferably, the accommodating space 30 is vertically partitioned, for efficient space utility. Since the second laundry machine 200 generates high vibration, as compared to the first laundry machine 100, it is preferred that the second laundry machine 200 be arranged in an accommodating space defined in a lower portion of the accommodating space 30, and the first laundry machine 100 be arranged in an accommodating space defined in an upper portion of the accommodating space 30.

The first and second laundry machines 100 and 200 are slidably installed such that it is forwardly slidable along the casing 20.

Figure 2:
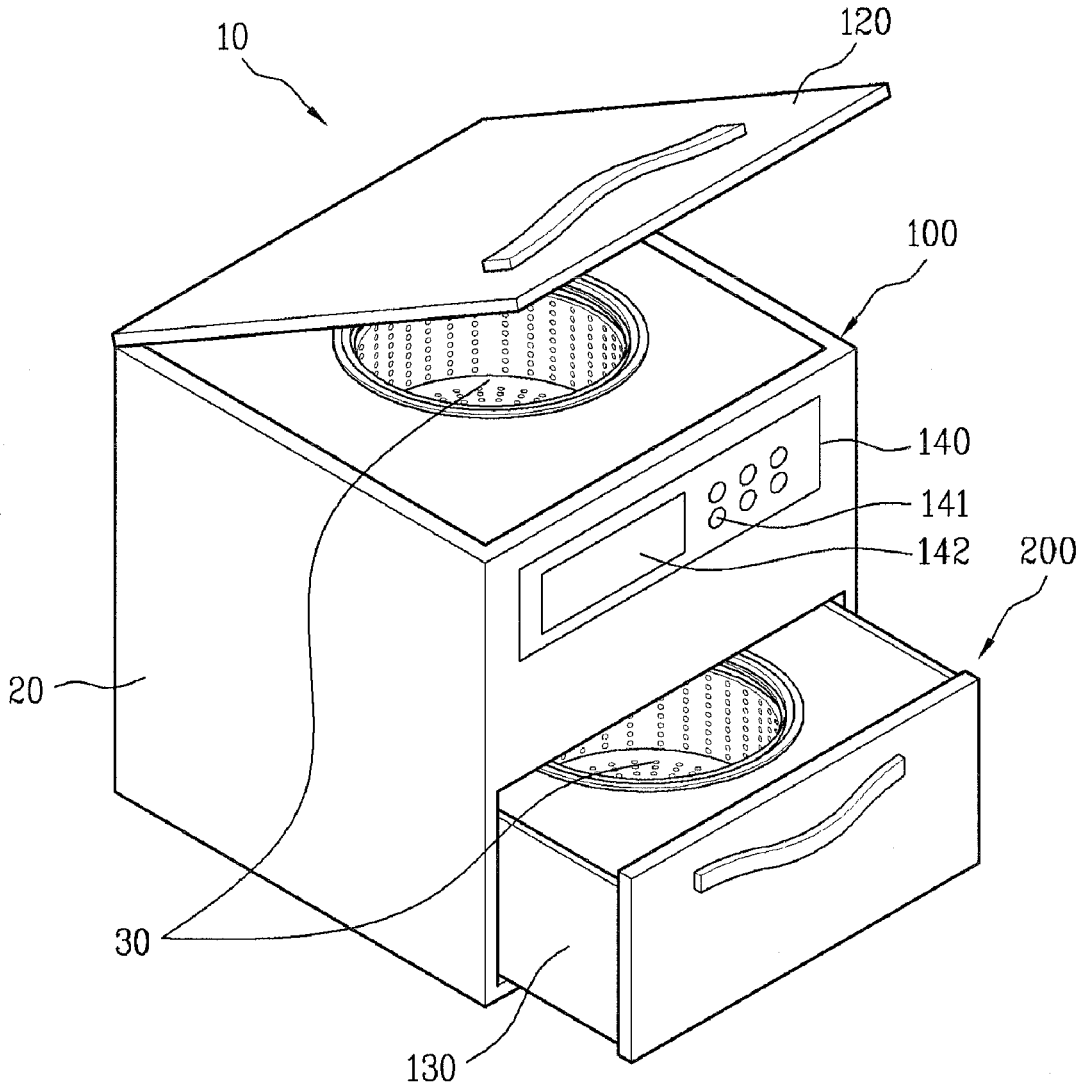
FIG. 2 is a perspective view illustrating a multiple laundry machine according to another embodiment of the present invention.

As shown in FIG. 2, the first laundry machine 100 may be of a top loading type, in which a door 120 is mounted at a top side of the casing 20, whereas the second laundry machine 200 may be slidably installed such that it is forwardly slidable.

The multiple laundry machine 100 may include a control panel 140.

That is, as shown in FIG. 1, the control panel 140 may comprise a plurality of control panels to independently control respective laundry machines.

Thus, the laundry machines 100 and 200, which are installed at upper and lower positions, include control panels 140, respectively. Accordingly, the laundry machines 100 and 200 are independently controlled to perform desired operations in an independent manner, respectively.

Preferably, each control panel 140 is arranged at a front side of the corresponding laundry machine 100 or 200. Of course, each control panel 140 may be arranged at any position, as long as there is no restriction in arranging the control panel 140 at the position.

Meanwhile, as shown in FIG. 2, for the control panel 140, a single control panel may be provided at the multiple laundry machine 100, to control both the overall operation of the first laundry machine 100 and the overall operation of the second laundry machine 200.

In this case, the control panel 140 includes a controller (not shown) for controlling operations of the laundry machines 100 and 200, a key input unit 141 for inputting a user command associated with each of the laundry machines 100 and 200, and a display 142 for displaying the user command input through the key input unit 141, and operation states.

The control panel 140 may also include a sound output unit (not shown) for audibly outputting information representing operation states of the laundry machines 100 and 200.

When the laundry machines 100 and 200 simultaneously conduct washing operations, the multiple laundry machine 10 according to the present invention may be controlled such that wash water used for a rinsing operation in the first laundry machine 100 arranged at the upper position can be selectively re-used in the second laundry machine 200 arranged at the lower position.

Figure 3:
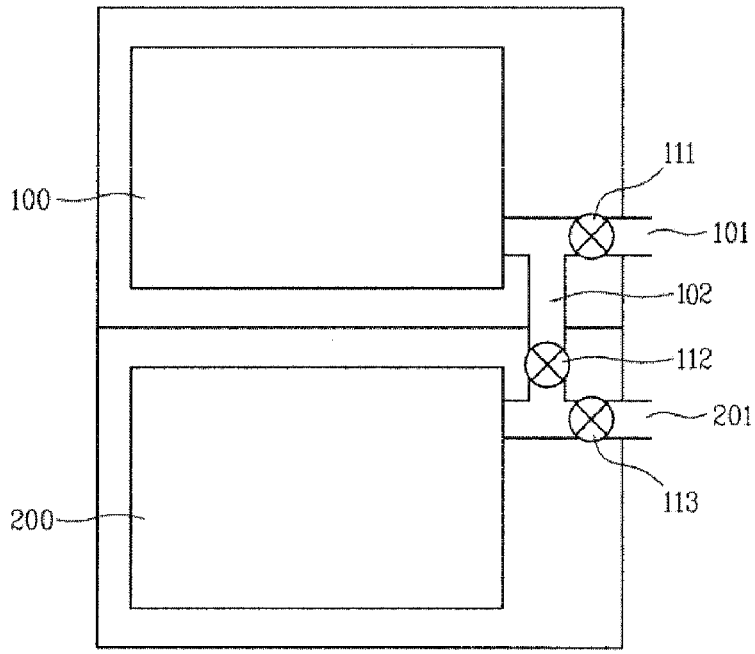
FIG. 3 is a sectional view illustrating a connecting pipe for re-use of wash water according to the present invention.

Referring to FIG. 3, the first laundry machine 100 arranged at the upper position includes a drainage pipe 101 connected to a water supply pipe 201 of the second laundry machine 200 arranged at the lower position.

A connecting pipe 102 is provided to connect the drainage pipe 101 of the first laundry machine 100 and the water supply pipe 201 of the second laundry machine 200.

A first valve 111 is arranged in the drainage pipe 101 of the first laundry machine 100. A second valve 112 is arranged in the connecting pipe 102. A third valve 113 is arranged in the water supply pipe 201 of the second laundry machine 200.

Since the drainage pipe 101 of the first laundry machine 100 arranged at the upper position and the water supply pipe 201 of the second laundry machine 200 arranged at the lower position are connected, wash water used to rinse delicate clothes contaminated in a low contamination degree can be re-used. Accordingly, there is an advantage in that saving of resources can be achieved.

When the first laundry machine 100 arranged at the upper position washes laundry contaminated in a high contamination degree, the first valve 111 is opened, and the second valve 112 is closed, to drain wash water used in the first laundry machine 100, through the drainage pipe 101, without re-use of the wash water. In this case, the third valve 113 is opened under the condition in which the second valve 112 is in a closed state, to supply water from an external water supply source to the second laundry machine 200.

When it is desired to re-use, in the second laundry machine 200, wash water used in the first laundry machine 100, the first valve 111 and third valve 113 are closed, and the second valve 112 is opened. Accordingly, wash water used in the first laundry machine 100 is supplied to the second laundry machine 200.

Hereinafter, an exemplary embodiment of the multiple laundry machine, in particular, each laundry machine, will be described in detail with reference to FIGS. 4 to 8.

Figure 4:
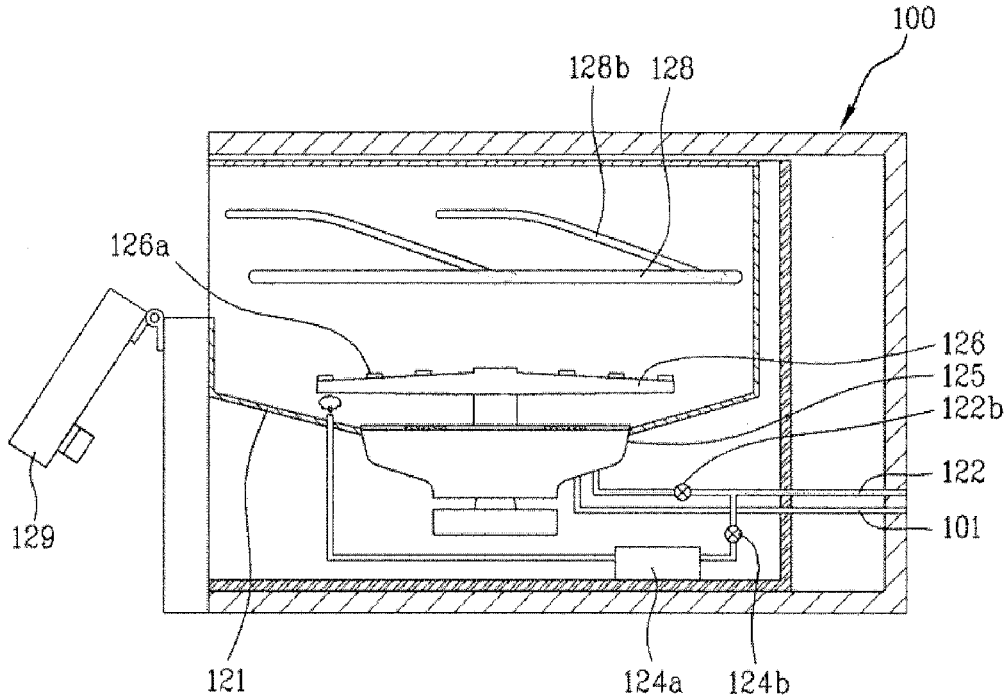
FIG. 4 is a sectional view illustrating a first laundry machine according to an exemplary embodiment of the present invention.

First, an exemplary embodiment of the first laundry machine 100 according to the present invention will be described with reference to FIG. 4.

In the illustrated embodiment, the first laundry machine 100 may include a tub 121 for providing a washing space, a rack 128 for holding laundry in a fixed state, and a sprayer 126 rotatably installed to spray wash water to the rack 128.

The tub 121 may be formed to be partially opened at a front side thereof. As shown in the drawings, it is preferred that the tub 121 be opened at an upper portion of the front side thereof, to receive wash water and to allow loading and unloading of laundry and insertion and ejection of the rack 128.

It is also preferred that the first laundry machine 100 be provided with a door 129 for opening/closing an opening formed through the front side of the tub 121.

The door 129 may be hinged to the casing such that it is vertically pivotable about a hinge in accordance with an operation of the user. The mounting of the door 129 may be achieved through various methods, as long as it does not interfere with the operation of the first laundry machine 100.

The sprayer 126 functions to spray wash water at a high pressure toward laundry held by the rack 128. A plurality of spray nozzles **126*a* are mounted on a top surface of the sprayer 126, to spray wash water. Lower nozzles (not shown) are mounted to a bottom surface of the sprayer 126 at opposite sides of the sprayer 126, respectively, to cause the sprayer 126** to be rotated in accordance with the hydraulic pressure of the wash water.

The sprayer 126 may have a structure enabling the sprayer 126 to be movable in a vertical direction and in a forward/rearward direction.

As wash water is sprayed onto the laundry held by the rack 128, a washing operation is carried out.

On the other hand, the washing operation may be carried out under the condition in which wash water is contained in the tub 121 such that laundry is sunk under the wash water. In this case, the washing operation is achieved through pulsation of the wash water generated by the rotating force of the sprayer 126.

The first laundry machine 100 further includes a water supply pipe 122 connected to the external water supply source, to supply wash water to the tub 121. As described above, the drainage pipe 101 is also included in the first laundry machine 100, to drain wash water contaminated after being used in a washing operation.

When wash water is supplied via the water supply pipe 122, a sump 125 collects the supplied wash water, and supplies the collected wash water to the tub 121 via the sprayer 126.

Although not shown, a washing pump is arranged in the sump 125, to pump the wash water collected in the sump 125, and thus to supply the wash water to the sprayer 126.

The first laundry machine 100 may further include a steam generator **124*a*** for supplying steam.

The steam generator **124*a*** may have the same structure as that of a steam generator used in a conventional washing machine.

In order to control the amount of wash water supplied to the tub 121, the first laundry machine 100 preferably includes a tub-side valve **122*b* for opening/closing the water supply pipe 122, and a steam-side valve 124*b* connected to the steam generator 124*a***.

The rack 128 is configured such that laundry is seated on the rack 128. The rack 128 is also configured such that it can be outwardly ejected through the opening of the tub 121, and can be adjusted in level within the tub 121.

The rack 128 will be described in detail with reference to FIG. 5.

The rack 128 includes guide protrusions **128*a* formed at opposite lateral ends of the rack 128. Guide grooves 128*b* are formed on an inner surface of the tub 121 at opposite sides of the tub 121, in order to receive the guide protrusions 128*a* such that the guide protrusions 128*a* are movable along the guide grooves 128*b***.

Figure 5:
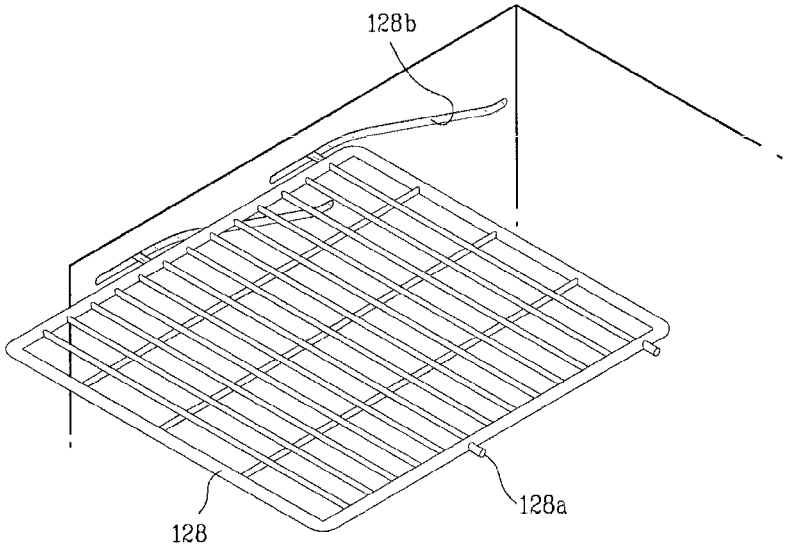
FIG. 5 is a perspective view illustrating a rack provided in accordance with the embodiment of FIG. 4.

It is preferred that the guide grooves **128*b* be inclined toward the bottom surface of the tub 121 as they extend inwardly from the opening of the tub 121, as shown in FIG. 5, such that the rack 128 can be forwardly ejected through the opening of the tub 121, to allow the user to lay laundry on the ejected rack 128, and the laundry laid on the rack 129** can be sunk under the wash water, to be effectively washed.

Thus, before the execution of a washing operation, the rack 128 is outwardly ejected through the opening of the tub 121, to allow laundry to be laid on the rack 128. Thereafter, the rack 128 is inserted into the tub 121 such that the laid laundry is sunk under the wash water in the tub 121. In this state, the washing operation is executed.

Another embodiment of the first laundry machine 100 according to the present invention will be described with reference to FIG. 6.

Figure 6:
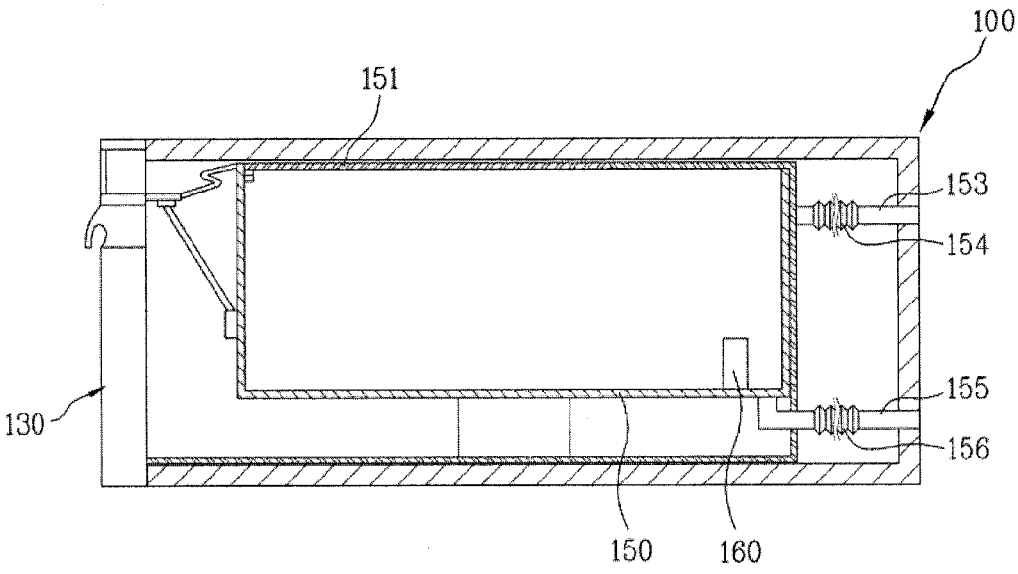
FIG. 6 is a sectional view illustrating a first laundry machine according to another embodiment of the present invention.

As shown in FIG. 6, the first laundry machine 100 includes a tub 150 for receiving wash water therein, and an ultrasonic washer 160 for vibrating the wash water received in the tub 150, to wash laundry.

Preferably, the first laundry machine 100 further includes a drawer 130 forwardly ejectable from the casing 20.

The casing 20 of the first laundry machine 100 is opened at a top side thereof, to allow loading/unloading of laundry. A door is mounted to the top side of the casing 20.

The tub 150 is opened at a top side thereof. A tub door 151 is mounted to the top side of the tub 150 around the opening of the tub 150. Since the first laundry machine 100 has a relatively low height, wash water contained in the tub 150 may be splashed away from the tub 150. The tub door 151 prevents such a phenomenon.

Although not shown, the ultrasonic washer 160 includes a vibrator for converting electrical energy into mechanical vibration energy, to generate ultrasonic waves, a booster coupled to the vibrator, to magnify the amplitude of the ultrasonic waves generated from the vibrator, and a horn coupled to the booster, to transfer the amplitude-magnified, namely, amplified, ultrasonic waves to the wash water contained in the tub 150.

When an electrical signal is applied to the vibrator, piezoelectric ceramics arranged in the vibrator vibrate while repeating retraction and expansion. Since the vibration of the piezoelectric ceramics has a low amplitude, the booster coupled to the vibrator receives the vibration of the piezoelectric ceramics, and magnifies the amplitude of the vibration.

The amplified vibration is transferred to the wash water contained in the tub 150, by the horn. As the vibration is transferred to the wash water, cavitating air bubbles are created in the wash water. The interior of the cavitating air bubbles is at a high temperature and under a high pressure, so that it is possible to sterilize bacteria existing in the wash water by the cavitating air bubbles.

The high temperature and pressure of the cavitating air bubbles are generated for a short time of several hundredths of a second to several thousandths of a second. By such a strong force, contaminants are dispersed and decomposed. Thus, a desired washing effect is obtained.

A drainage pipe 155 is connected to the bottom of the tub 150, to drain wash water from the tub 150.

It is preferred that the drainage pipe 155 include a longitudinally-extendable/contractible bellows tube 156 forming a portion of the drainage pipe 155. When the drawer 130 is forwardly ejected, the bellows tube 156 is extended.

In place of the bellows tube structure, a telescopic structure may be used.

A water supply pipe 153 is connected to an upper portion of the tub 150, to supply water. Similarly to the drainage pipe 155, the water supply pipe 153 includes a bellows tube 154.

Another embodiment of the first laundry machine according to the present invention will be described with reference to FIG. 7.

Figure 7:
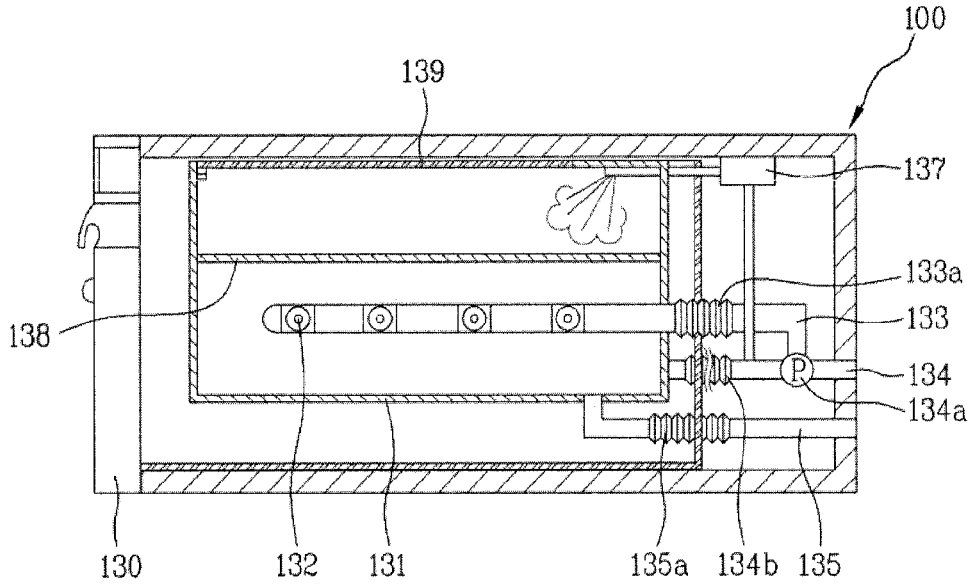
FIG. 7 is a sectional view illustrating a first laundry machine according to another embodiment of the present invention.

As shown in FIG. 7, the first laundry machine 100 includes a tub 131 for providing a washing space, a rack 138 for holding laundry in a fixed state in the tub 131, and a plurality of spray ports 132 formed through a wall of the tub 131, to spray wash water to the rack 128.

Preferably, the first laundry machine 100 further includes a drawer 130 forwardly ejectable from the casing 20.

The casing 20 of the first laundry machine 100 is opened at a top side thereof, to allow loading/unloading of laundry. A door is mounted to the top side of the casing 20.

The tub 131 is opened at a top side thereof. A tub door 139 is mounted to the top side of the tub 131 around the opening of the tub 131. Since the first laundry machine 100 has a relatively low height, wash water contained in the tub 131 may be splashed away from the tub 131. The tub door 139 prevents such a phenomenon.

The spray ports 132 sprays wash water into the tub 131 at a high pressure. The sprayed wash water is again supplied to the spray ports 132, so that the wash water is circulated. The sprayed wash water is used to achieve a washing operation.

In order to circulate the wash water, the first laundry machine 100 includes a circulating pump 134*a*, a discharge pipe 134 connected to the circulating pump 134*a*, and a supply pipe 133 connected to an outlet end of the circulating pump 134*a*. The supply pipe 133 extends along the periphery of the tub 131.

Preferably, the supply pipe 133 and discharge pipe 134 include longitudinally-extendable/contractible bellows tube 133*a* and 134*b* forming portions of the supply pipe 133 and discharge pipe 134, respectively. When the drawer 130 is forwardly ejected, the bellows tubes 133*a* and 134*b* are extended.

In place of the bellows tube structure, a telescopic structure may be used.

A drainage pipe 135 is connected to the bottom of the tub 131, to drain wash water. Similarly to the pipes 133 and 134, the drainage pipe 135 includes a bellows tube 135*a*.

A steam generator 137 may be provided to supply steam to the tub 131. Although not shown, an air supplier may also be provided to spray air bubbles through the spray ports 132, together with wash water.

Since wash water and air bubbles are simultaneously sprayed into the tub 131, it is possible to perform a washing operation, using friction generated between the laundry and the wash water and air bubbles.

The washing operation may also be performed under the condition in which wash water is filled in the tub 131. In this case, the wash water pulsates due to the air bubbles. Accordingly, the washing operation can be more effectively achieved by the sprayed wash water and the pulsation of the wash water.

The steam generator 137 and air supplier may have the same structures as those of a steam generator and an air supplier used in a conventional washing machine.

Figure 8:
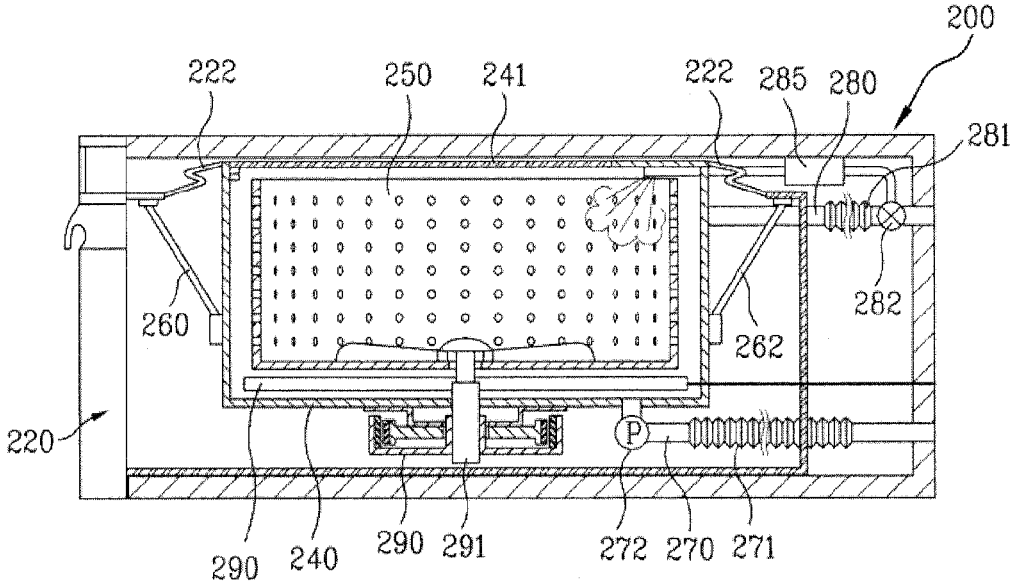
FIG. 8 is a sectional view illustrating a second laundry machine according to an exemplary embodiment of the present invention.

Hereinafter, a first embodiment of the second laundry machine 200 according to the present invention will be described in reference to FIG. 8.

In this embodiment, the second laundry machine 200 includes an outer tub 240 for receiving wash water, an inner tub 250 rotatably installed in the outer tub 240, to pulsate laundry contained in the inner tub 250, and a motor 290 for providing a rotating force to the inner tub 250.

Preferably, the second laundry machine 200 further includes a drawer 220 forwardly ejectable from the casing 20.

The outer tub 240 is supported by the drawer 220. To support the outer tub 240, supporters 260 and 262 are preferably provided.

Preferably, a gasket 222, which is made of a flexible sealing material, is provided to prevent water and foreign matter from penetrating between the outer tub 240 and the drawer 220.

The outer tub 240 is opened at a top side thereof. An outer tub door 241 is mounted to the top side of the outer tub 240 around the opening of the outer tub 240. Since the second laundry machine 200 has a relatively low height, wash water contained in the outer tub 240 may be splashed away from the outer tub 240. The outer tub door 241 prevents such a phenomenon.

The inner tub 250 is arranged within the outer tub 240. A plurality of through holes are formed through the inner tub 250, to allow wash water to enter and exit the inner tub 250.

A motor 290 is fixedly mounted to a lower surface of the bottom of the outer tub 240. The motor 290 includes a rotating shaft 291 extending through the bottom of the outer tub 240 so that it is directly connected to the bottom of the inner tub 250.

A drainage pipe 270 is connected to the bottom of the outer tub 240, to drain wash water. A drainage pump 272 is connected to the drainage pipe 270.

It is preferred that the drainage pipe 270 include a longitudinally-extendable/contractible bellows tube 271 forming a portion of the drainage pipe 270. When the drawer 220 is forwardly ejected, the bellows tube 271 is extended.

In place of the bellows tube structure, a telescopic structure may be used.

A water supply pipe 280 is connected to an upper portion of the outer tub 240, to supply water. A water supply valve 282 is arranged in the water supply pipe 280. Similarly to the drainage pipe 270, the water supply pipe 280 includes a bellows tube 281.

A steam generator 285 may be provided to supply steam to the outer tub 240.

A heater 286 may also be provided to heat wash water contained in the outer tub 240, and thus to achieve a laundry boiling function.

The steam generator 285 and heater 286 have the same structures as those of a steam generator and a heater used in a conventional washing machine.

Another embodiment of the second laundry machine 200 according to the present invention will be described with reference to FIG. 9.

Figure 9:
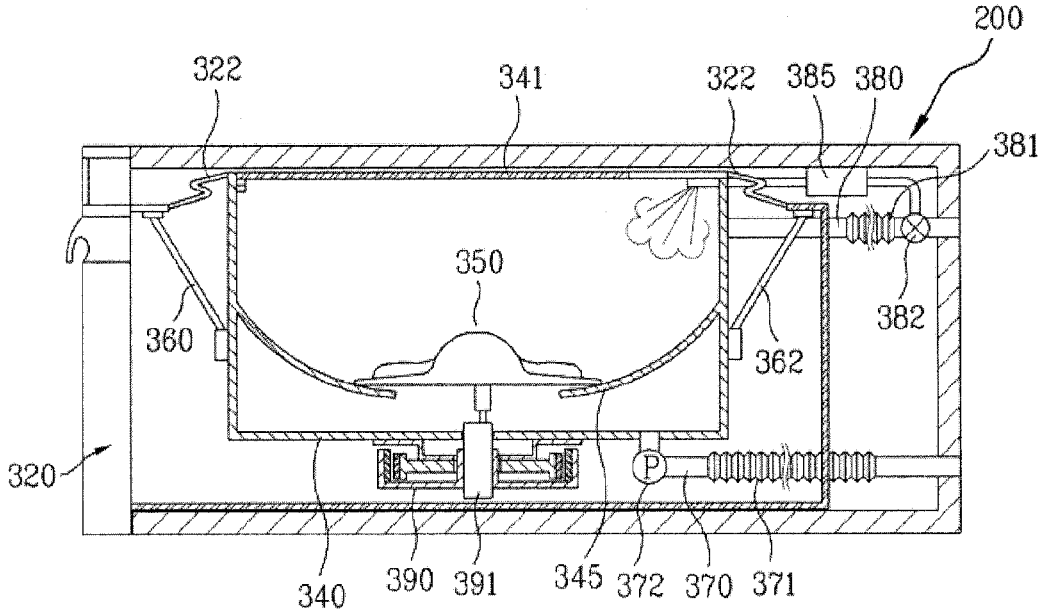
FIG. 9 is a sectional view illustrating a second laundry machine according to another embodiment of the present invention.

As shown in FIG. 9, the second laundry machine 200 includes a tub 340 for receiving wash water, a pulsator 350 rotatably mounted in the tub 340, to pulsate the wash water, and a motor 390 for applying a rotating force to the pulsator 350.

Preferably, the second laundry machine 200 further includes a drawer 320 forwardly ejectable from the casing 20.

The tub 340 is supported by the drawer 320. To support the tub 340, supporters 360 and 362 are preferably provided.

Preferably, a gasket 322, which is made of a flexible sealing material, is provided to prevent water and foreign matter from penetrating between the tub 340 and the drawer 320.

The tub 340 is opened at a top side thereof. A tub door 341 is mounted to the top side of the tub 340 around the opening of the tub 340. Since the second laundry machine 200 has a relatively low height, wash water contained in the tub 340 may be splashed away from the tub 340. The tub door 341 prevents such a phenomenon.

The pulsator 350 is arranged in the tub 340 such that it can wobble.

Preferably, a guide 345 having a concave shape is formed in the tub 340.

The motor 390 is fixedly mounted to a lower surface of the bottom of the tub 340. The motor 390 includes a rotating shaft 391 extending through the bottom of the tub 340 so that it is directly connected to the bottom of the pulsator 350.

A drainage pipe 370 is connected to the bottom of the tub 340, to drain wash water. A drainage pump 372 is connected to the drainage pipe 370.

It is preferred that the drainage pipe 370 include a longitudinally-extendable/contractible bellows tube 371 forming a portion of the drainage pipe 370. When the drawer 320 is forwardly ejected, the bellows tube 371 is extended.

In place of the bellows tube structure, a telescopic structure may be used.

A water supply pipe 380 is connected to an upper portion of the tub 340, to supply water. A water supply valve 382 is arranged in the water supply pipe 380. Similarly to the drainage pipe 370, the water supply pipe 380 includes a bellows tube 381.

A steam generator 385 may be provided to supply steam to the tub 340.

Although not shown, a heater may also be provided to heat wash water contained in the tub 340, and thus to achieve a laundry boiling function.

The steam generator 385 and heater have the same structures as those of a steam generator and a heater used in a conventional washing machine.

As apparent from the above description, the multiple laundry machine according to the present invention can perform a washing operation for a small amount of laundry, and can separately wash laundry in accordance with the kind of the laundry.

When the laundry machines of the multiple laundry machine operate simultaneously, it is possible to re-use wash water used for a rinsing operation, and thus to save resources.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A multiple laundry machine, comprising:

a casing; and a plurality of laundry machines arranged in the casing, wherein each of the plurality of laundry machines is configured to conduct a different washing operation, wherein the plurality of laundry machines comprises:

a first laundry machine configured to conduct a first washing operation in which laundry received therein is maintained in a fixed state; and a second laundry machine configured to conduct a second washing operation which applies a rotating force to laundry items received therein, wherein the first and second laundry machines are forwardly slidable from the casing, and wherein the first laundry machine comprises:

a tub that defines a washing space therein;

a rack that holds laundry in a fixed state in the washing space; and a steam generator that supplies steam to the tub, and wherein the second laundry machine comprises:

an outer tub that receives washing fluid therein;

an inner tub rotatably installed in the outer tub so as to rotate laundry received therein; and a motor that provides a rotating force to the inner tub.

2. The multiple laundry machine according to claim 1, wherein the casing comprises an accommodating space defined in the casing, to accommodate the plurality of laundry machines.

3. The multiple laundry machine according to claim 2, wherein the accommodating space is partitioned into vertically arranged sub-spaces so as to receive the first and second laundry machines therein.

4. The multiple laundry machine according to claim 1, wherein the first laundry machine comprises a drainage pipe, and the second laundry machine comprises a water supply pipe connected to the drainage pipe of the first laundry machine.

5. The multiple laundry machine according to claim 1, wherein each of the plurality of laundry machines comprises a heater for heating wash water so as to achieve a laundry boiling function.

6. The multiple laundry machine according to claim 1, further comprising:

a controller for controlling overall operation of each of the plurality of laundry machines such that the plurality of laundry machines are simultaneously controlled;

a key input unit that receives a command associated with each of the plurality of laundry machines; and a display for displaying the command received through the key input unit or an operation state of one or more of the plurality of laundry machines.

7. The multiple laundry machine according to claim 1, further comprising:

a controller for controlling operations of each of the plurality of laundry machines such that the plurality of laundry machines are independently controlled;

a key input unit that receives a command associated with each of the plurality of laundry machines; and a display for displaying the command received through the key input unit or an operation state of at least one of the plurality of laundry machines.

* * * * *